US009313849B2

(12) United States Patent
Stepps et al.

(10) Patent No.: US 9,313,849 B2
(45) Date of Patent: Apr. 12, 2016

(54) DIMMING CONTROL SYSTEM FOR SOLID STATE ILLUMINATION SOURCE

(71) Applicants: Dale B. Stepps, Plantation, FL (US); Bernard Corwin, Morris, IL (US)

(72) Inventors: Dale B. Stepps, Plantation, FL (US); Bernard Corwin, Morris, IL (US)

(73) Assignee: Silescent Lighting Corporation, Fort Lauderdale, FL (US)

( * ) Notice: Subject to any disclaimer, the term of this patent is extended or adjusted under 35 U.S.C. 154(b) by 230 days.

(21) Appl. No.: 13/947,394

(22) Filed: Jul. 22, 2013

(65) Prior Publication Data

US 2014/0203733 A1 Jul. 24, 2014

Related U.S. Application Data

(60) Provisional application No. 61/755,684, filed on Jan. 23, 2013.

(51) Int. Cl.

| | |
|---|---|
| ***H05B 41/16*** | (2006.01) |
| ***H05B 41/24*** | (2006.01) |
| ***H05B 33/08*** | (2006.01) |

(52) U.S. Cl.
CPC ..... *H05B 33/0845* (2013.01)

(58) Field of Classification Search
CPC ..... H05B 33/0845; H05B 33/0848; H05B 33/0851; H05B 33/0875
USPC ..... 315/246, 291, 292, 294
See application file for complete search history.

(56) References Cited

U.S. PATENT DOCUMENTS

| | | | |
|---|---|---|---|
| D60,004 | S | 12/1921 | Adam |
| D78,750 | S | 6/1929 | Gunnison |
| D129,357 | S | 9/1941 | Greppin |
| D132,276 | S | 5/1942 | Greppin |
| D143,336 | S | 12/1945 | Morrison |
| D150,357 | S | 7/1948 | Herbster |
| D155,680 | S | 10/1949 | Baker |
| D164,606 | S | 9/1951 | Schlage |
| D234,797 | S | 4/1975 | John et al. |
| 4,369,490 | A | 1/1983 | Blum |
| 4,396,882 | A | 8/1983 | Kellenbenz |
| 4,471,268 | A | 9/1984 | Brown et al. |
| D303,437 | S | 9/1989 | Mason |
| 4,910,654 | A | 3/1990 | Forge |

(Continued)

FOREIGN PATENT DOCUMENTS

| | | |
|---|---|---|
| WO | WO 2009/064433 | 5/2009 |
| WO | WO 2009/064434 | 5/2009 |

*Primary Examiner* — Kenneth B Wells
(74) *Attorney, Agent, or Firm* — Malloy & Malloy, P.L.

(57) ABSTRACT

A system for dimming a solid state illumination source, such as a light emitting diode, including a low pass analog filter operative to extract a direct current (DC) voltage component from an incoming alternating current (AC) waveform. A microprocessor is structured to digitally filter the DC voltage resulting from the analog filter and extract dimming data associated with a dimming operation of the LED. The microprocessor includes monitoring capabilities operative to detect predetermined characteristics of the dimming data associated with the dimming operation. The predetermined characteristics are determinative of manual control of the dimming operation or non-manual activation of a dimming signal. The predetermined characteristics which are determinative of manual control may include, but not be limited to, speed of voltage change, direction of voltage change and amount of voltage change associated with the dimming signal delivered to the LED.

18 Claims, 3 Drawing Sheets

(56) References Cited

U.S. PATENT DOCUMENTS

| | | | | |
|---|---|---|---|---|
| D339,651 | S | 9/1993 | Vieyra | |
| D365,159 | S | 12/1995 | Tinen | |
| 5,604,411 | A * | 2/1997 | Venkitasubrahmanian et al. | 315/307 |
| 5,652,504 | A | 7/1997 | Bangerter | |
| D385,897 | S | 11/1997 | Lin | |
| 5,738,436 | A | 4/1998 | Cummings et al. | |
| D397,482 | S | 8/1998 | Binsukor | |
| D405,216 | S | 2/1999 | Porter et al. | |
| D413,137 | S | 8/1999 | Lin | |
| 5,953,221 | A | 9/1999 | Kuhn et al. | |
| 6,013,988 | A | 1/2000 | Bucks et al. | |
| 6,016,038 | A * | 1/2000 | Mueller et al. | 315/291 |
| 6,094,014 | A | 7/2000 | Bucks et al. | |
| 6,147,458 | A | 11/2000 | Bucks et al. | |
| 6,160,359 | A | 12/2000 | Fleischmann | |
| 6,188,177 | B1 | 2/2001 | Adamson et al. | |
| 6,211,626 | B1 * | 4/2001 | Lys et al. | 315/291 |
| 6,234,645 | B1 | 5/2001 | Borner et al. | |
| 6,234,648 | B1 | 5/2001 | Börner et al. | |
| 6,250,774 | B1 | 6/2001 | Begemann et al. | |
| 6,304,464 | B1 | 10/2001 | Jacobs et al. | |
| 6,375,338 | B1 | 4/2002 | Cummings et al. | |
| 6,388,388 | B1 | 5/2002 | Weindorf et al. | |
| 6,472,828 | B1 | 10/2002 | Pruett et al. | |
| D469,211 | S | 1/2003 | Homann | |
| 6,561,690 | B2 | 5/2003 | Balestriero et al. | |
| 6,577,512 | B2 | 6/2003 | Tripathi et al. | |
| 6,586,890 | B2 * | 7/2003 | Min et al. | 315/224 |
| 6,608,617 | B2 | 8/2003 | Hoffknecht et al. | |
| 6,617,795 | B2 | 9/2003 | Bruning | |
| 6,642,674 | B2 | 11/2003 | Liao et al. | |
| 6,692,136 | B2 | 2/2004 | Marshall et al. | |
| D490,182 | S | 5/2004 | Benensohn | |
| 6,744,223 | B2 * | 6/2004 | Laflamme et al. | 315/291 |
| D493,188 | S | 7/2004 | Brueck | |
| 6,788,011 | B2 * | 9/2004 | Mueller et al. | 315/294 |
| 6,827,470 | B2 | 12/2004 | Sagal et al. | |
| 6,856,890 | B2 | 2/2005 | Muto et al. | |
| 6,922,022 | B2 | 7/2005 | Bucks et al. | |
| D509,016 | S | 8/2005 | Benghozi | |
| 6,972,525 | B2 | 12/2005 | Bucks et al. | |
| 6,975,079 | B2 | 12/2005 | Lys et al. | |
| 7,038,399 | B2 * | 5/2006 | Lys et al. | 315/291 |
| 7,129,933 | B1 | 10/2006 | Nishikawa et al. | |
| 7,183,727 | B2 | 2/2007 | Ferguson et al. | |
| 7,186,000 | B2 | 3/2007 | Lebens at al. | |
| 7,202,608 | B2 | 4/2007 | Robinson et al. | |
| 7,233,115 | B2 | 6/2007 | Lys | |
| 7,252,385 | B2 | 8/2007 | Engle et al. | |
| 7,256,554 | B2 | 8/2007 | Lys | |
| 7,262,559 | B2 | 8/2007 | Tripathi et al. | |
| D550,391 | S | 9/2007 | Cesaro | |
| D554,974 | S | 11/2007 | Huang | |
| D556,075 | S | 11/2007 | Teiber et al. | |
| 7,300,173 | B2 | 11/2007 | Catalano et al. | |
| 7,329,024 | B2 | 2/2008 | Lynch et al. | |
| 7,348,736 | B2 | 3/2008 | Piepgras et al. | |
| 7,352,138 | B2 | 4/2008 | Lys et al. | |
| 7,358,681 | B2 | 4/2008 | Robinson et al. | |
| 7,358,706 | B2 | 4/2008 | Lys | |
| 7,377,683 | B2 | 5/2008 | Koegler et al. | |
| 7,394,212 | B2 | 7/2008 | Wey et al. | |
| 7,420,335 | B2 | 9/2008 | Robinson et al. | |
| 7,459,864 | B2 | 12/2008 | Lys | |
| D591,448 | S | 4/2009 | Huang | |
| 7,522,615 | B2 | 4/2009 | Binder | |
| D592,347 | S | 5/2009 | Trott et al. | |
| D592,348 | S | 5/2009 | Trott et al. | |
| 7,557,521 | B2 | 7/2009 | Lys | |
| 7,587,289 | B1 | 9/2009 | Sivertsen | |
| D602,193 | S | 10/2009 | Soderman et al. | |
| D602,195 | S | 10/2009 | Soderman et al. | |
| D604,008 | S | 11/2009 | Soderman et al. | |
| 7,722,227 | B2 | 5/2010 | Zhang et al. | |
| 7,737,643 | B2 | 6/2010 | Lys | |
| 7,760,107 | B1 | 7/2010 | Stepps et al. | |
| 7,802,902 | B2 | 9/2010 | Moss et al. | |
| 7,810,960 | B1 | 10/2010 | Soderman et al. | |
| 7,878,692 | B2 | 2/2011 | Soderman et al. | |
| 7,980,736 | B2 | 7/2011 | Soderman et al. | |
| 8,011,794 | B1 | 9/2011 | Sivertsen | |
| 8,029,158 | B2 | 10/2011 | Chen | |
| 8,098,021 | B2 | 1/2012 | Wang et al. | |
| 8,154,221 | B2 | 4/2012 | Godbole et al. | |
| 8,226,272 | B2 | 7/2012 | Chen | |
| 8,237,381 | B2 | 8/2012 | Harbers et al. | |
| 8,258,706 | B2 | 9/2012 | Maruyama et al. | |
| 8,344,639 | B1 | 1/2013 | Bahrehmand | |
| 8,348,470 | B2 | 1/2013 | Liu et al. | |
| 8,360,614 | B1 | 1/2013 | Soderman et al. | |
| 8,368,310 | B1 | 2/2013 | Roosli | |
| 8,398,253 | B2 | 3/2013 | Sivertsen | |
| 8,531,226 | B2 | 9/2013 | Montalbo et al. | |
| 8,534,873 | B1 | 9/2013 | Soderman et al. | |
| 8,573,812 | B2 | 11/2013 | Joung et al. | |
| 8,643,300 | B1 | 2/2014 | Stepps et al. | |
| 8,674,544 | B2 | 3/2014 | Rada et al. | |
| 8,714,797 | B2 | 5/2014 | Hwu et al. | |
| 8,957,610 | B2 * | 2/2015 | Lee | 318/139 |
| 9,014,829 | B2 * | 4/2015 | Chemel et al. | 700/90 |
| 9,054,584 | B2 * | 6/2015 | Haight et al. | |
| 2003/0072160 | A1 | 4/2003 | Kuepper et al. | |
| 2003/0102845 | A1 | 6/2003 | Aker et al. | |
| 2004/0135523 | A1 | 7/2004 | Takahashi et al. | |
| 2005/0213047 | A1 | 9/2005 | Slobodin et al. | |
| 2006/0126328 | A1 | 6/2006 | Coushaine | |
| 2007/0114010 | A1 | 5/2007 | Upadhya et al. | |
| 2007/0139923 | A1 | 6/2007 | Negley et al. | |
| 2007/0223230 | A1 | 9/2007 | Trojanowski et al. | |
| 2007/0242461 | A1 | 10/2007 | Reisenauer et al. | |
| 2007/0279821 | A1 | 12/2007 | Sells | |
| 2008/0007944 | A1 | 1/2008 | Verfuerth et al. | |
| 2009/0109052 | A1 | 4/2009 | Stepps et al. | |
| 2009/0122553 | A1 | 5/2009 | Soderman et al. | |
| 2009/0195168 | A1 | 8/2009 | Greenfeld | |
| 2009/0278479 | A1 | 11/2009 | Platner et al. | |
| 2009/0303602 | A1 | 12/2009 | Bright et al. | |
| 2010/0134038 | A1 | 6/2010 | Shackle et al. | |
| 2010/0134047 | A1 | 6/2010 | Hasnain | |
| 2010/0271178 | A1 | 10/2010 | Ahmad | |
| 2010/0314641 | A1 | 12/2010 | Schmidt | |
| 2011/0012530 | A1 | 1/2011 | Zheng et al. | |
| 2011/0026251 | A1 | 2/2011 | Liu et al. | |
| 2011/0095703 | A1 | 4/2011 | Wilson et al. | |
| 2011/0317423 | A1 | 12/2011 | Chen | |
| 2012/0092870 | A1 | 4/2012 | Tralli et al. | |
| 2012/0146505 | A1 | 6/2012 | Jonsson | |
| 2013/0043833 | A1 | 2/2013 | Katz et al. | |
| 2014/0301062 | A1 | 10/2014 | David et al. | |

* cited by examiner

DIMMING CONTROL SYSTEM FOR SOLID STATE ILLUMINATION SOURCE

CLAIM OF PRIORITY

The present application is based on and a claim of priority is made under 35 U.S.C. Section 119(e) to a provisional patent application that is currently in the U.S. Patent and Trademark Office, namely, that having Ser. No. 61/755,684 and a filing date of Jan. 23, 2013, and which is incorporated herein in its entirety by reference.

BACKGROUND OF THE INVENTION

1. Field of the Invention

This invention is directed to a dedicated dimming system applicable for use with solid state illumination sources, such as LED technology, which provides proper and accurate control of a dimming operation therefor. The system is structured to be easily retrofitted for use with previously installed or existing dimmer systems for incandescent illumination sources. Moreover, whether or not installed as a retrofit, the dimmer system of the present invention is operative to distinguish an intended manual control of a dimming operation of the LED light source, from a non-manual event including a power anomaly in the power supplied to the LED light source.

2. Description of the Related Art

As is recognized, phase control dimmers "chop" an AC waveform to reduce power to light loads, thereby causing a diminishing of light intensity or a "dimming" of a light source. The chop or distortion of the AC waveform essentially comprises a portion of the AC waveform being removed for a period of time of each AC cycle (180 degrees). Accordingly, known phase control dimmers work best with incandescent lamps that present a resistive load to the dimmer. In contrast, light emitting diode (LED) drivers present a reactive load to the dimmer. This means that the LED driver will distort the AC current and voltage significantly by drawing non-linear currents while operating. They also present a zero load condition to the dimmer each AC cycle. Such a zero load condition causes dimmer operation to misfire resulting in a "flicker" or noted visual fluctuation in the intensity of illumination generated. As a result, dimming LED lights with electronic drivers associated with technology designed to drive incandescent bulbs is problematic.

Further factors affecting accurate and reliable operation of LED dimmer assemblies include the fact that power quality in many buildings or other facilities is deteriorating. This is at least partially due to the proliferation of AC/DC power supplies for electronic equipment. Such equipment includes, but is not limited to, computers, telephone equipment, copy machines, fax machines and essentially any device that requires DC voltage to operate, but is fed by AC voltage in the building. Switching power supplies are typically not "power factor corrected" and as such draw their charging current at the peak of the incoming AC waveform. This results in a "flattening" of the waveform because high peak currents cause resistive voltage loss in the building's wiring and transformer cores. Further, the reactive loads from motors and some lighting facilities contribute to the distortion of the AC waveforms. The poor power quality causes LED drivers to misfire and create the "flicker" in the LED currents.

Accordingly, there is a need in this area for a dedicated dimmer solution to be applied for use with solid state illumination sources, including LED lighting technology. Such a preferred system and attendant solution will provide proper and accurate control with minimal risk of misfire. Moreover, a preferred and proposed system for dimming solid state illumination sources can compensate for less than ideal power quality conditions and/or disruptive power supplies.

SUMMARY OF THE INVENTION

The present invention is directed to a dimming system and attendant mode of operation which is adaptable, but not limited, to a retrofit application with previously installed and/or existing dimmer systems for incandescent illumination sources.

More specifically, the dimming system and method of the present invention comprises a constant low pass, analog filter operative to essentially extract the direct current (DC) value of an incoming "chopped" alternating current (AC) waveform. In addition, the analog filter is structured to remove most of the offensive distortion associated with the chopped AC waveform. In at least one preferred embodiment, the present invention includes a powerful microprocessor structured to digitally filter the DC voltage created by the analog filter and extract "dimming data" associated with a dimming operation of the LED light source.

Moreover, the microprocessor includes monitoring capabilities operative to detect predetermined characteristics of the dimming data. As such, the detected predetermined characteristics will be determinative of an intended manual control of the dimming operation of the light source. In contrast, a false dimming signal can be sent to the LED light source when the predetermined characteristics are absent or not found in the dimming data.

In operation, the predetermined characteristics can include, but are not necessarily limited to, the speed of the voltage change associated with the dimming signal, the direction of the voltage change (increasing or diminishing) thereof and the amount of the voltage change. In more specific terms, if the respective operative range or parameters of the above noted predetermined characteristics of the dimming data are present, the microprocessor is structured to recognize that the dimming operation is intentional and in fact manually controlled or activated. In turn, the microprocessor then generates and/or directs a control signal to the LED light source causing a change in the light intensity, in terms of diminishing or increasing the intensity, as desired and affected by the manual operation.

As explained in greater detail hereinafter, at least one preferred embodiment of the system of the present invention is operative to monitor the direction and speed of an apparent dimming signal, which occurs when it appears that a dimming operation is being attempted. More specifically, what would normally appear to be an attempt to perform a change in light intensity of the LED light source, may in fact be an anomaly in the power supply. Accordingly, the operative features of one or more of the preferred embodiments of the present invention determine, based on the presence or absence of the aforementioned predetermined characteristics, if a variance in the light intensity was manually created or an anomaly of the power environment associated with the operation of the LED light source.

Further by way of example, if the rate of speed of the voltage change in an apparent dimming signal is less than 50-100 milliseconds, the microprocessor determines that the dimming signal is in fact generated by a power anomaly. As a result, the processor is operative to ignore the dimming signal by categorizing it as non-manual generated signal. In turn no dimming control signal is generated. Conversely, a dimming signal that continues voltage change in a single direction and/or evidences a movement rate of greater than 50-100 milliseconds is preferably treated as a purposeful dimming signal, being manually controlled. In such a situation, the illumination intensity of the LED light source is adjusted accordingly by sending a proper control signal from the microprocessor to the LED light source.

In one or more preferred embodiments, the microprocessor is also calibrated for target dimming states to make sure that the LED driver will always have enough voltage available for the illumination of the LED at a given light setting. This ability to "re-slope" when a zero light output point occurs on an AC waveform helps to create a "no-flicker" LED light intensity during a phase dimming operation. To further effectuate a "flicker-free" illumination and insure that sufficient power is always present to drive the LED light source, one or more of the preferred embodiments of the present system also comprises the calibration of the zero light point to the appropriate phase angle of the light form for specific location and/or environment in which the system is installed. This compensates for variations and/or fluctuations that may exist between different lighting environments.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

The present invention is directed to a system for varying the illumination level or intensity, such as by dimming, of a solid state illumination source, wherein the illumination source comprises one or more light emitting diodes (LED) 18. The system 10 may be incorporated in any of a plurality of different illumination environments such as, but not limited to, that represented in FIG. 1. More specifically, one or more embodiments of the subject dimming system and its attendant mode of operation is adaptable, but not limited, to a retrofit application with previously installed and/or existing dimmer systems for incandescent illumination sources.

Figure 1:
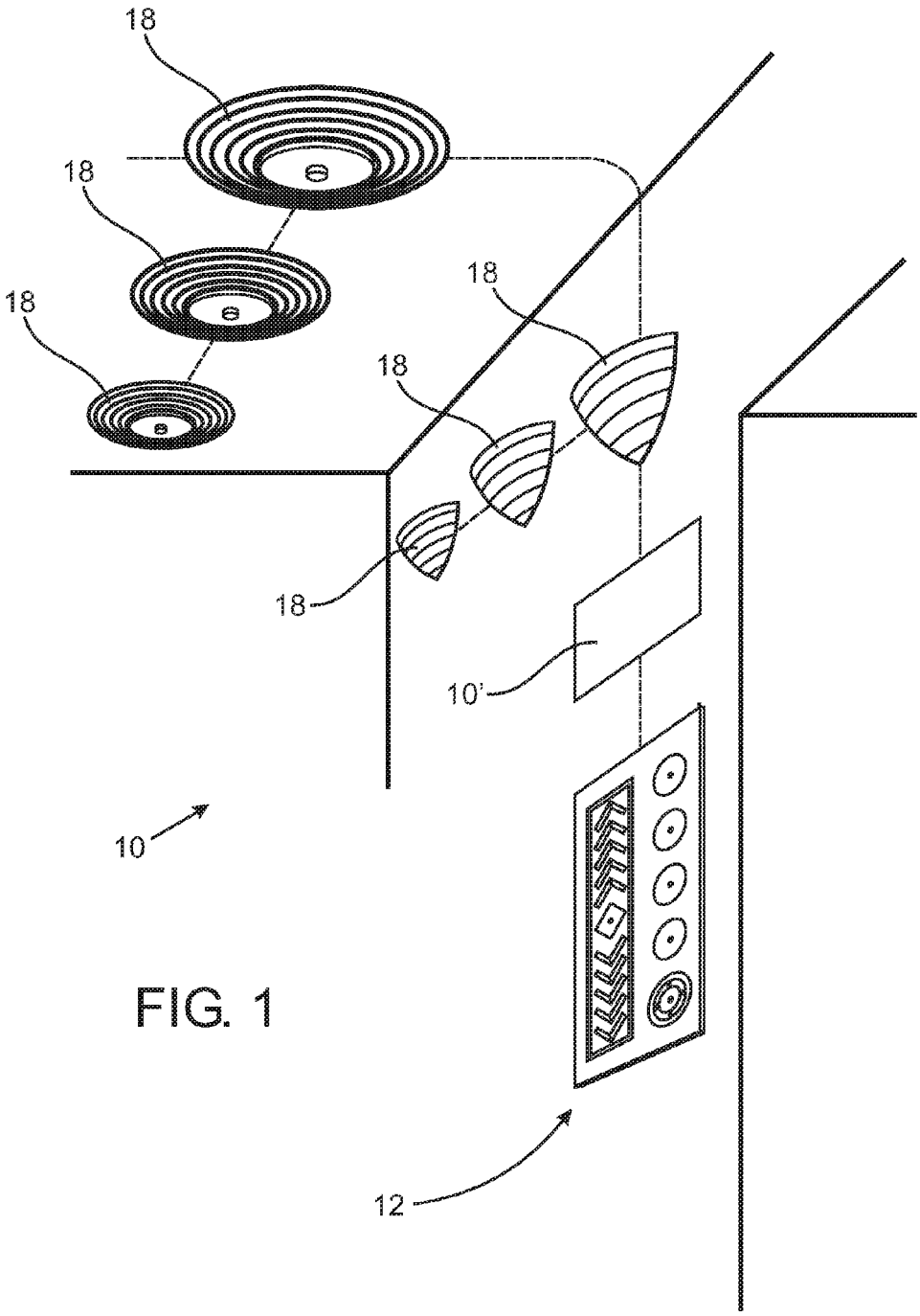
FIG. 1 is a perspective view in schematic form of the present invention structured to be installed possibly, but not necessarily, as a retrofit of any of a possible plurality of lighting environments, which may or may not have originally been an incandescent lighting system.
Figure 2:
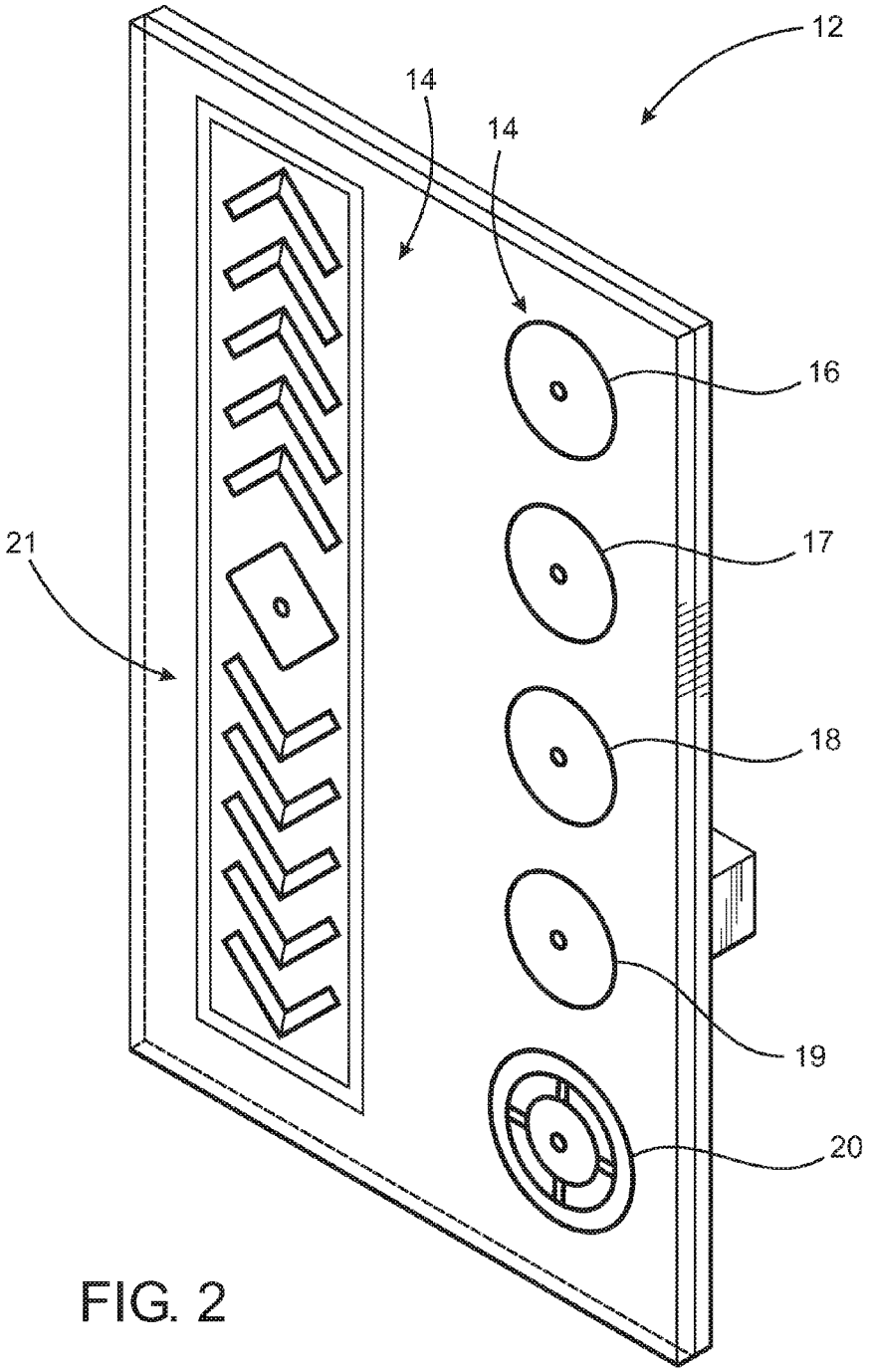
FIG. 2 is a perspective view representing one of a possible plurality of control facilities and/or touch pads, which may have initially been used to manually perform a dimming operation on an incandescent illumination source and because of a possible retrofit application of the system of the present invention, is operable to perform a dimming operation on a solid state illumination source.

Accordingly, with reference to FIGS. 1 and 2, the schematically represented illumination environment may or may not have initially been comprised of one or a plurality of incandescent light sources, wherein the aforementioned solid state illumination source comprising one or more light emitting diodes (LED) 18 have been substituted therefor. It is therefore emphasized the dimming control system and its method of operation may be used in combination with an originally installed solid state illumination assembly such as, but not limited to, that incorporating one or more LED's. Alternately, the dimming control system of the present invention may be retrofitted into a dimming control for a previously installed illumination system incorporating one or more incandescent light sources. As such, the control panel or touch pad is intended to schematically represent any of a plurality of control devices which may have originally been structured and operative to perform a dimming procedure on incandescent light sources or on an originally installed solid state illumination assembly.

Therefore, the manual operation of the dimming procedure associated with the dimming system of the present invention may be accomplished by one or more switching assemblies or touch pads 12. Further, the components and/or circuitry associated implementation of the dimming system 10 is operatively connected to the power supply and control facilities or touch pad 12, as at 10'. As indicated the control panel or touch pad 12 is provided by way of example only and is representative of different types of illumination control assemblies or touch pads capable of controlling the operation, at least to the extent of the on-off mode, as well as the regulation of the light intensity of the LED light source 18.

Accordingly, and with primary reference to FIG. 2, the structurally operative details of each of one or more of a possible plurality of switching assemblies, touch pad or light control panels 12 are at least schematically represented. Further by way of example, each touch pad 12 may include a plurality of control members collectively and generally represented as 14. Moreover, the plurality of control members 14 preferably include diverse structures and functions that are cooperatively associated to work in consort with one another to accomplish on-off activation or operation as well as well as the performance of the dimming operation. Accordingly, the touch pad or light control facilities 12 may comprise a plurality of touch pad buttons 16 through 20 and at least one linear slider member 21, which collectively define the control members 14. Moreover, manual contact and/or sliding engagement of the hand of a user with the slider 21 may serve to vary the light intensity level in terms of performing the dimming operation. Accordingly, the term "dimming operation" as used herein is meant to describe the intentional variance of the intensity or brightness level of illumination of the one or more LED's 18. Therefore, and as set forth above, the control facilities 12 are used to manually control the intensity or level of illumination of the LED(s) 18.

Further by way of example and as demonstrated in the schematic representation of FIG. 1, the control facilities or touch pad 12 are electrically connected in current regulating relation to a conventional electrical power supply and thereby provides electrical current to the one or more solid state illumination sources, such as LED's 18.

Figure 3:
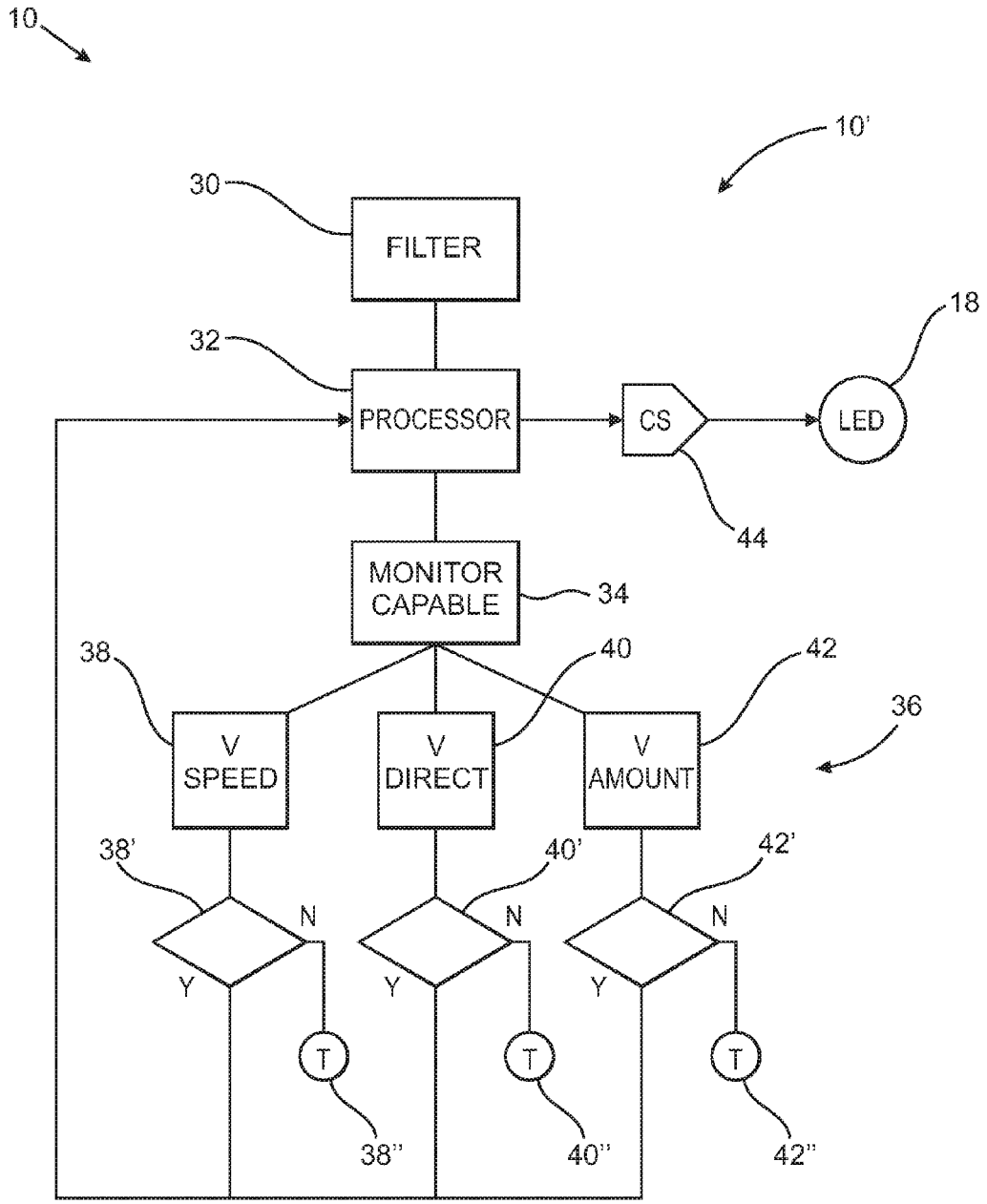
FIG. 3 is a schematic representation in block diagram form of the operative features associated with the present invention.

Accordingly, and with primary reference to FIGS. 1 and 3, the present invention includes the dimming system 10, wherein the operative components and/or circuitry 10' thereof include a constant low pass analog filter 30 operative to essentially extract direct current (DC) value of an incoming "chopped" alternating current (AC) waveform. In addition, the analog filter is structured to remove most of the offensive distortion associated with the chopped AC waveform. In at least one preferred embodiment, the present invention includes a powerful microprocessor 32 structured to digitally filter the DC voltage created by the analog filter 30 and extract "dimming data" associated with the dimming operation for the LED light source 18.

As further schematically represented in FIG. 3, the microprocessor 32 includes monitoring capabilities 34. The monitoring capabilities 34 are operative to detect predetermined characteristics, generally indicated as 36, associated with the dimming data. Such predetermined characteristics 36 to be detected by the monitoring capabilities 34 will be determinative of an intended manual control of the dimming operation of the LED source 18. In contrast, a "false dimming signal" can be generated which would normally result in a variance of the light intensity of the led 18. Such a false or invalid dimming signal may be determined or detected by the absence of the predetermined characteristics 36 when not found or present in the dimming data.

As also more specifically represented in FIG. 3, the predetermined characteristics 36 can include, but are not necessarily limited to, the speed of the voltage change 38 associated with a generated dimming signal, the direction of the voltage change 40 thereof and the amount of voltage change as at 42. In more specific terms, if one or more of the above designated predetermined characteristics 36 are respectively within preset parameters or operative range, the microprocessor 32 is structured to recognize that the dimming operation is intentional and in fact manually activated or controlled. The microprocessor 32 then generates a control signal 44 to the one or more LED's 18, causing a change in the light intensity thereof. Variance or change in the light intensity may be in terms of diminishing or increasing the intensity and the attendant light level as desired and effected by the manual operation of the slider 21 or other components of the control facilities or touch panel 12.

Further with regard to FIG. 3, the monitoring capabilities 34 of the microprocessor 32 include the existence of any one or all of the predetermined characteristics 38, 40 and 42 in the dimming data. If one or more or a combination of the predetermined characteristics 38, 40 and 42 are outside their respective preset parameters or operative ranges, then the determination or decision, as at 38', 40' and/or 42' is made and the generation of a control or light intensity dimming signal 44 is prevented from being generated by the microprocessor 32. Moreover, any dimming operation that is recognized as being invalid, serves to terminate the dimming operation, as at 38", 40" and 42". In contrast, if any of the predetermined characteristics 38, 40 and 42 are within the preset parameters, set forth in greater detail hereinafter, then a positive indication is detected by the monitoring capabilities 34 and the microprocessor 32 is structured to generate the control signal 44 to the one or more LED's 18, serving to vary the light intensity level.

Further by way of example if the rate of speed of the voltage change, as at 40, in the apparent dimming data is less than 50-100 milliseconds, the microprocessor 32 determines that the dimming signal is in fact generated by a power anomaly or other non-intentional or non-manual event. As a result the microprocessor 32 is structured to ignore the dimming signal, as at 38' by categorizing is as a non-manual generated signal and the dimming operation is terminated 38". As a result, no dimming control signal 44 is generated by the microprocessor 32. Conversely, a dimming signal that continues voltage change in a single indicative direction and/or evidences a movement rate of greater than 50-100 milliseconds is preferably treated as a purposeful or valid dimming signal, being manually controlled such as at the control facilities or touch pad 12. In such a situation the illumination intensity of the LED light source 18 is adjusted accordingly by sending a valid control signal 44 from the microprocessor 32 to the one or more of the LED light sources 18.

Additional preferred embodiments of the present invention, include the microprocessor 32 being calibrated for target dimming states to make sure that an LED driver will always have sufficient voltage available for the illumination for the LED(s) 18 at a given light setting. This ability to "re-slope" when zero light output occurs on an AC wave-form helps to create a "no-flicker" LED light intensity during a phase dimming operation. Further, in order to establish the "flicker-free" illumination of an LED light source, as well as assure that sufficient power is always present to drive the LED light source, one or more embodiments of the present invention further comprises calibration of the zero light point to the appropriate phase angle for specific environments in which the system is installed, such as that schematically represented in FIG. 1. This calibration compensates for the variations and/or fluctuations that exist between different lighting environments.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A system for dimming a light emitting diode (LED) illumination source, said system comprising:

an analog filter operative to extract a direct current (DC) voltage value from an incoming alternating current (AC) waveform, a microprocessor structured to digitally filter the DC voltage resulting from said analog filter and extract dimming data associated with a dimming operation for the LED, said microprocessor including monitoring capabilities operative to detect predetermined characteristics of said dimming data, said predetermined characteristics determinative of manual control of said dimming operation, and, said predetermined characteristics including at least speed of a voltage change associated with said dimming operation.

2. A system as recited in claim 1 wherein said speed of voltage change greater than 100 milliseconds being indicative of manual control of said dimming operation.

3. A system as recited in claim 1 wherein said predetermined characteristics are selected from the group consisting of speed of voltage change, direction of voltage change and amount of voltage change.

4. A system as recited in claim 3 wherein said predetermined characteristics being within respective operative ranges is indicative of manual control of said dimming operation.

5. A system as recited in claim 4 wherein said microprocessor is structured to direct an intensity control signal to the LED, operative to adjust light intensity thereof.

6. A system as recited in claim 5 wherein generation of said intensity control signal is dependent on a determination of said dimming operation being manually controlled.

7. A system as recited in claim 4 wherein said predetermined characteristics being outside respective operative ranges is indicative of non-manual control of said dimming operation.

8. A system as recited in claim 4 wherein said predetermined characteristics being outside respective operative ranges is indicative of a power anomaly.

9. A system as recited in claim 1 wherein said microprocessor is structured to direct an intensity control signal to the LED, operative to adjust light intensity thereof to the extent of affecting dimming of the LED.

10. A system as recited in claim 9 wherein generation of said intensity control signal is dependent on a determination of said dimming operation being manually controlled.

11. A system as recited in claim 1 further comprising said microprocessor being calibrated to effectuate at least sufficiently minimum voltage available to the LED to establish no-flicker illumination at zero light level intensities.

12. A system for dimming a solid state illumination source retrofitted into an original illumination source comprising incandescent lighting, said system comprising:

an analog filter operative to extract a direct current (DC) voltage value from an incoming alternating current (AC) waveform, a microprocessor structured to digitally filter the DC voltage resulting from said analog filter and extract dimming data associated with a dimming operation for the LED, said microprocessor structured to direct an intensity control signal to the solid state illumination source being operative to adjust light intensity thereof, said microprocessor including monitoring capabilities operative to detect predetermined characteristics of said dimming data determinative of manual control of said dimming operation, said predetermined characteristics being outside respective operative ranges indicative of non-manual control of said dimming operation, and wherein generation of said intensity control signal is dependent on a determination of said dimming operation being manually controlled.

13. A system as recited in claim 12 wherein said predetermined characteristics are selected from the group consisting of speed of voltage change, direction of voltage change and amount of voltage change.

14. A system as recited in claim 12 further comprising said microprocessor being calibrated to effectuate at least sufficiently minimum voltage available to the LED to establish no-flicker illumination at zero light level intensities.

15. A system as recited in claim 12 wherein the solid state illumination comprises at least one LED.

16. A system for dimming a light emitting diode (LED) illumination source, said system comprising:

an analog filter operative to extract a direct current (DC) voltage value from an incoming alternating current (AC) waveform, a microprocessor structured to digitally filter the DC voltage resulting from said analog filter and extract dimming data associated with a dimming operation for the LED, said microprocessor including monitoring capabilities operative to detect predetermined characteristics of said dimming data, said predetermined characteristics determinative of manual control of said dimming operation, and, said predetermined characteristics including at least direction of a voltage change associated with said dimming operation.

17. A system as recited in claim 16 wherein said direction of voltage change in a single direction is indicative of manual control of said dimming operation.

18. A system for dimming a light emitting diode (LED) illumination source, said system comprising:

an analog filter operative to extract a direct current (DC) voltage value from an incoming alternating current (AC) waveform, a microprocessor structured to digitally filter the DC voltage resulting from said analog filter and extract dimming data associated with a dimming operation for the LED, said microprocessor including monitoring capabilities operative to detect predetermined characteristics of said dimming data, said predetermined characteristics determinative of manual control of said dimming operation, and, said predetermined characteristics including at least an amount of a voltage change associated with said dimming operation.

* * * * *